United States Patent [19]

Deigmuller et al.

[11] 4,250,792

[45] Feb. 17, 1981

[54] PROCESS FOR THE PRODUCTION OF COMPACTED EXPLOSIVE CHARGES

[75] Inventors: Gunter Deigmuller, Steyergerg; Andreas Munk, Haiger; Bruno Rohe, Burbach-Wurgendorf; Manfred Strunk, Heuenrade, all of Fed. Rep. of Germany

[73] Assignee: Dynamit Nobel Aktiengesellschaft, Fed. Rep. of Germany

[21] Appl. No.: 16,536

[22] Filed: Mar. 1, 1979

[30] Foreign Application Priority Data

Mar. 20, 1978 [DE] Fed. Rep. of Germany ..... 2813179

[51] Int. Cl.[3] ..... C06B 21/00

[52] U.S. Cl. ..... 86/1 R; 102/56 SC; 102/24 HC; 264/3 R

[58] Field of Search ..... 86/1 R; 102/24 HC, 56 SC; 264/3 R

[56] References Cited

U.S. PATENT DOCUMENTS

| | | | |
|---|---|---|---|
| 3,034,393 | 5/1962 | Lieberman et al. | 102/24 HC |
| 3,255,659 | 6/1966 | Venghiattis | 102/24 HC |
| 3,661,086 | 5/1972 | Thomanek et al. | 102/56 SC |
| 3,736,875 | 6/1973 | Bucklishch | 102/56 SC |
| 3,924,510 | 12/1975 | Strunk et al. | 86/1 R |
| 3,978,795 | 9/1976 | Strunk et al. | 102/56 SC |

FOREIGN PATENT DOCUMENTS

| | | | |
|---|---|---|---|
| 2460303 | 10/1978 | Fed. Rep. of Germany | 102/56 SC |

*Primary Examiner*—Leland A. Sebastian
*Attorney, Agent, or Firm*—Craig & Antonelli

[57] ABSTRACT

A process for the production of compacted explosive charges, especially hollow charges, wherein a pulverulent explosive is compacted to form a charge within a compacting chamber and an inert body is arranged in the charge, the inert body is arranged within the compacting chamber in a predetermined starting position, to be displaceable in the compacting direction; and the pulverulent explosive surrounding the inert body is compacted under displacement of the inert body.

6 Claims, 6 Drawing Figures

PROCESS FOR THE PRODUCTION OF COMPACTED EXPLOSIVE CHARGES

Figure 1:
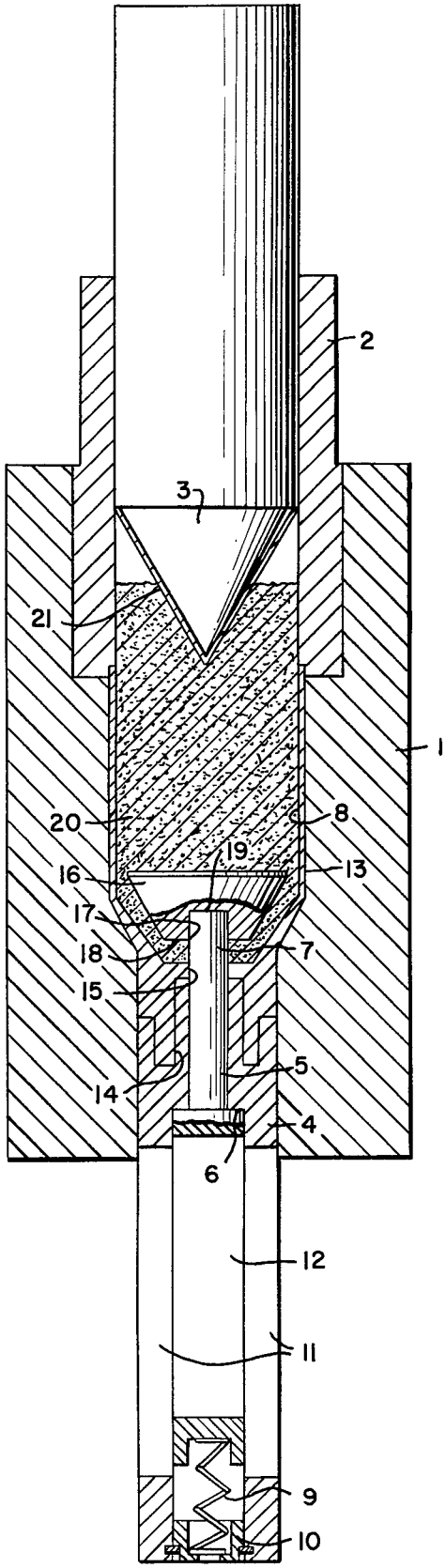

The invention relates to a process for forming compacted explosive charges from a pulverulent explosive wherein the explosive compacted about an inert body within a compacting chamber.

It is known to manufacture explosive charges from a pulverulent explosive by compacting, wherein the pulverulent explosive provided in a compacting chamber is axially compressed in an appropriate fashion with the aid of hydraulic or eccentric presses, for example. The compacting chamber can be constituted by a press tool or also by a casing or envelope of metallic or nonmetallic materials, surrounding the explosive charge. If the casing cannot withstand the compacting pressure, it is, in turn, arranged within a press tool lending support to the casing. The explosive charges compacted without a casing are generally inserted into such casing subsequently and then glued to the casing, but they can also be utilized without a casing in certain cases.

To attain a control of the detonation of the explosive charge, particularly in case of hollow charges, the explosive charge has embedded therein an inert body which itself does not participate in the detonation but rather preferably only provides a deflection of the detonation therearound, although another possibility is to controllably pass the shock wave through such body. This inert body is preferably made of a metal, but it can also be manufactured from nonmetals, for example a synthetic resin. The inert body is surrounded entirely or at least almost entirely by the compacted explosive, so that an igniter means arranged centrally behind the inert body directly adjoins the compacted explosive and thus insures the flawless transmission of the ignition impulse to the explosive. Due to the fact that the centrally disposed inert body is embedded in the explosive, such charges are compacted in several stages, as described, for example, in DOS (German Unexamined Laid-Open Application) No. 2,239,281.

The charges can be made from various explosives or explosive mixtures, especially of high explosives which do not lend themselves to casting, or which can be cast only with difficulties, such as, for example, hexogen or octogen. To improve the compacting ability of the powdery explosives or explosive mixtures, one or more lubricants can be added thereto, such as graphite, stearates, or waxes.

A disadvantage in these conventional processes for producing compacted explosive charges with an embedded inert body resides in that the compacting operation must be executed in several stages, which is not only expensive but also gives rise, for example, to irregularities in the charge structure and thus to varying efficiencies of the explosive charges.

The invention is based on the objective of avoiding the above-described disadvantages, i.e. of making it possible to compact the charges in one compacting step while simultaneously inserting during the pressing operation the inert body which controls the detonation. The charges are fashioned particularly as hollow charges, but they can also be fragmentation shells, for example, wherein the fragmentation direction is to be controlled by a predetermined course of the detonation by means of inert bodies introduced into the charges. In cases of hollow charges, the hollow charge insert, which especially is made of copper, is added during the same compacting step used to compact the pulverulent explosive. The charge is preferably pressed directly into the casing, but is can also be compacted in a press die and inserted in the casing as a finished, compacted element, or it can also be utilized without a casing in certain instances.

In accordance with the present invention this object is attained in that the inert body is arranged in the pulverulent, non-compacted explosive in a preselected defined position and, during the compacting of the explosive, with an appropriate axial guidance, the inert body is shifted in such a way that the explosive surrounding the inert body is uniformly compressed. The inert body is arranged, in accordance with the invention, so to speak in a floating fashion within the quasi-fluid, non-compacted explosive, so that the required, uniform compacting over the entire axial length of the charge, i.e. in front of as well as behind the inert body, is attained during the pressing step. The process of this invention makes it advantageously possible to introduce the entire amount of explosive pertaining to one charge into the compacting chamber, and only then to effect the compacting to the respectively required final density in a single compacting step, while simultaneously a body controlling the detonation is incorporated during the compacting step, this body being arranged centrally and unencumbered within the finished explosive charge. In this way, fissures, gaps, cavities, larger differences in density, or the like, as they can occur during the compacting operation comprising two or more stages, under unfavorable circumstances, where precompressed partial charges are furthermore used in certain cases, are reliably prevented in a very simple way.

The inert body must be embedded in the compacted, finished explosive charge in a defined fashion. Therefore, the body is arranged prior to the compacting step in the compacting chamber in a defined, preselected, starting position, from which it is shifted during the compacting step without tilting or lateral displacement in the pressing direction into its final position. The final position is determined by the maximum compacting pressure and the "pushing together" or compacting of the loose explosive particles dependent thereon, with the inert body being entrained. To insure this defined displacement of the inert body in the compacting direction even under adverse circumstances, the body is advantageously guided so that it can execute only a linear translatory motion in the compacting direction. Consequently, in one suitable embodiment of the invention guidance is provided by means of a central mandrel extending in the pressing direction, i.e. it is arranged coaxially; with one of its ends, the mandrel extends into the compacting chamber and is detachably connected to the inert body. However, instead, it is also possible, for example, to provide several mandrels supporting the inert body on its underside and guiding same axially, and it is furthermore feasible to provide for a lateral guidance of the inert body unless this unduly impairs the uniform structuring of the explosive layer surrounding the inert body and thus the control of the detonation.

A mandrel can basically be arranged in a non-displaceable position with respect to the compacting chamber, so that then a possibility for displacement must be provided between the inert body and the mandrel, for example by the feature that one component displaceably extends into a recess of the other component in the form of a blind hole and is supported therein in the axial direction by way of a spring. The starting position is determined by an abutment at one component, against which the other component is urged by the force of the spring. A prerequisite for such an axial displaceability is an adequate axial length of the inert body, which frequently is not present and/or is undesirable. Therefore, in accordance with another embodiment, the provision is made by the invention that, instead, the mandrel is shifted relatively to the compacting chamber due to the compacting pressure, so that no relative displacement is required between the mandrel and the inert body, and the inert body can be fashioned with a correspondingly shortened length. The mandrel is pressed, in its initial position, against an abutment by means of a holding force; this abutment is provided, for example, in the press tool. The axial holding force can be exerted, for instance, hydraulically or pneumatically, but is preferably provided by a pretensioned spring. During the pressing (i.e. compacting) step, the mandrel is displaced, preferably against the holding force which constantly acts thereon, in correspondence with the translatory motion of the inert body.

The pulverulent explosive can be filled into the compacting chamber, for example, by first introducing a partial amount, then inserting the inert body in its starting position, and subsequently introducing the remainder of the explosive. The insertion of the inert body takes place preferably so that the previously charged explosive is compacted either not at all or at most insubstantially. Preferably, however, the procedure instead is such that the inert body is centrally arranged in the still empty compacting chamber in the predetermined starting position, wherein an annular gap is produced between the body and the inner wall of the compacting chamber; this annular gap exhibits along its circumference at least no substantial interruptions. Thereafter, the amount of explosive required for forming a compacted charge is introduced, the explosive flowing via the annular gap also into the empty space underneath the inert body. The introduction of the explosive is carried out advantageously along the rim of the chamber, whereby the flowing of the explosive into the space between the wall of the compacting chamber and the inert body is enhanced. In case of hollow charges which have a conical, spherical, or the like indentation covered by a lining at their end oppositely to the inert body, it is furthermore advantageous that, during the introduction of the explosive, an explosive surface area is automatically produced at the end of the filling step which rises toward the rim, promoting the formation of the indentation. The introduction of the explosive along the wall of the compacting chamber can be effected, for example, by means of a conical distributor, the explosive being centrally fed in the region of the tip so that the explosive is poured in uniform distribution over the rim of the distributor downwardly along the wall of the compacting chamber.

Hollow charges are provided with a hood-like cover at its end provided with the indentation, this hood protecting the hollow charge insert arranged in the indentation from the penetration of foreign substances, with a view toward a maximally favorable formation of the hollow-charge ignition flash, and furthermore insuring, if required, the necessary distance to the target object. This cover, which is also called a ballistic hood in case of a hollow-charge projectile, is threadedly inserted with its rear end into the front end of the explosive charge casing, namely the mouth of the casing, and exerts during this step pressure on the rim of the hollow charge insert, whereby the latter is fixedly brought in contact with the explosive without the formation of gaps. To compensate for manufacturing tolerances, a spacer ring, elastically yielding in the axial direction, is generally also provided between the rim of the insert and the rearward end face of the cover. The internal thread at the mouth of the casing is disadvantageous if the explosive is directly pressed into the casing. The step of directly pressing the explosive into the casing is preferred to avoid the complicated subsequent insertion of the compacted element in the casing, which must be effected without gap formation. During the compacting within the casing, the explosive may be ignited by the internal thread, so that special precautions must be provided to counteract this danger.

In accordance with a further suggestion of this invention, this danger can be entirely avoided by gluing the cover hood into the casing; during this step, the hollow charge insert, contacting the explosive without any gaps, is simultaneously fixed reliably in position as an added advantage. In this connection, the insert is preferably glued directly to the casing, but is can also be glued together only with the cover hood, if desired. The process according to claim 5 can be utilized advantageously not only in the compacting of a hollow explosive charge with inert body in accordance with this invention, but can also be employed in other compacting processes for the production of a hollow explosive charge with cover hood.

The inert body is preferably fashioned so that the impact of the detonation emanating from the igniter means arranged centrally behind the inert body does not pass through the inert body but rather is conducted around the body, to obtain an annular ignition of the explosive charge. For this purpose, the inert body must have a minimum length or minimum height dependent on the conditions of a particular case, which length or height is frequently undesirably large. In such instances, the construction which is provided with a hollow space, proves to be particularly advantageous, which makes it possible, under otherwise identical conditions, to advantageously reduce the height of the inert body. The hollow space of the inert body is arranged in an axial extension in front of the igniter means, so that the shock wave propagated from there in the forward direction is prevented from passing through the inert body due to the air cushion in the hollow space in conjunction with the remaining wall thickness of the inert body.

The hollow space can be fashioned, for example, as a space which is closed off all around in the interior of the inert body. Preferably, however, the hollow space will be fashioned as a central recess. This central recess in the form of a blind hole furthermore establishes a simple, detachable connection of the mandrel with the inert body, in that the mandrel is threadedly inserted in the recess, or is arranged therein in a sliding seat, or in some other way. It also proves to be advantageous to provide that the igniter means extends with its front end into the recess and contacts the wall of the latter, so that an inherently self-contained air cushion is formed in front of the igniter means.

The arrangement of a hollow space in the inert body is not only advantageous in the compacting method according to this invention and in the preferred utilization of the positioning and guiding mandrel for the inert body, but is also basically of advantage in other manufacturing processes for embedding an inert body in an explosive charge, i.e., for example, also in case of cast explosive charges.

Figure 1A:
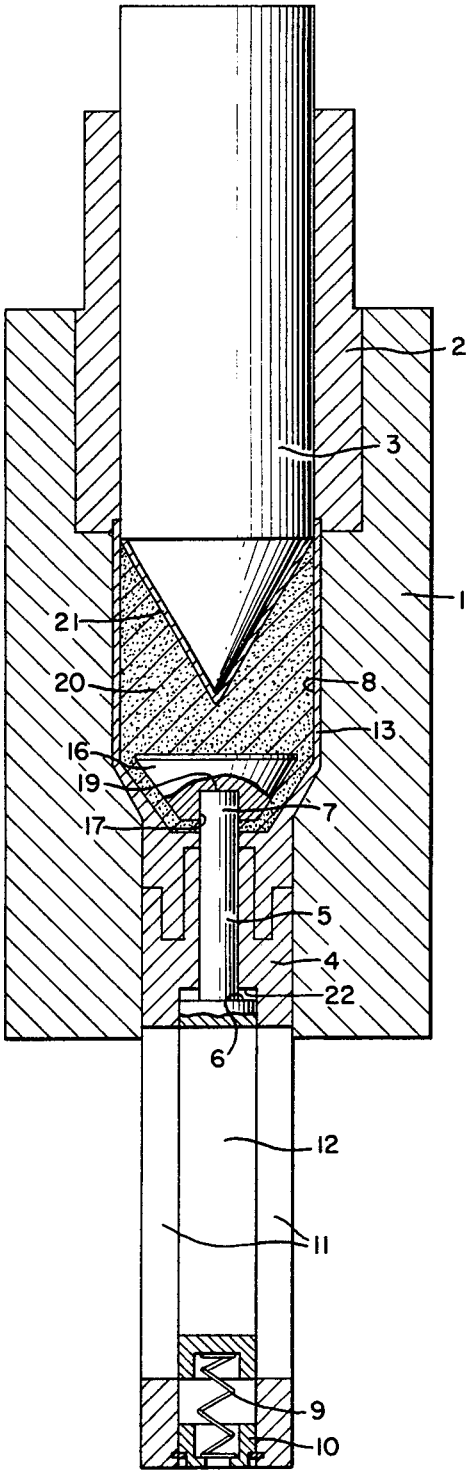
Figure 2:
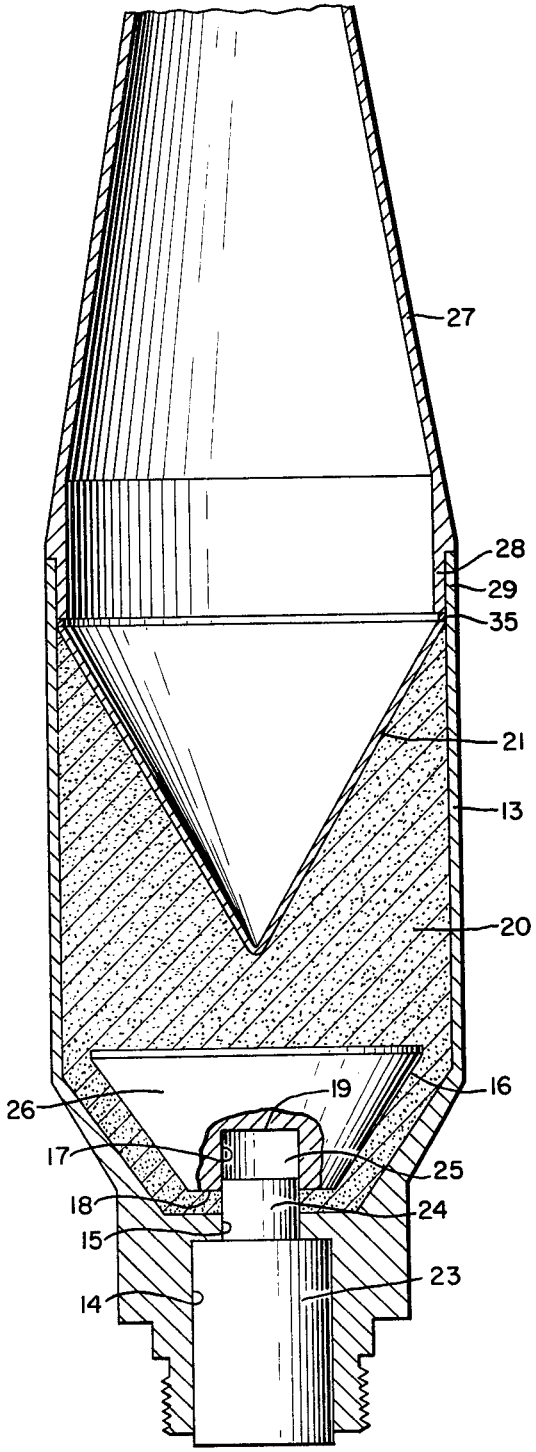
Figure 2A:
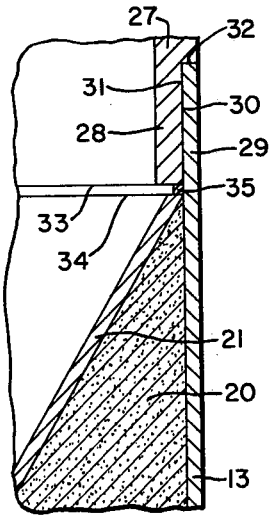
Figure 3:
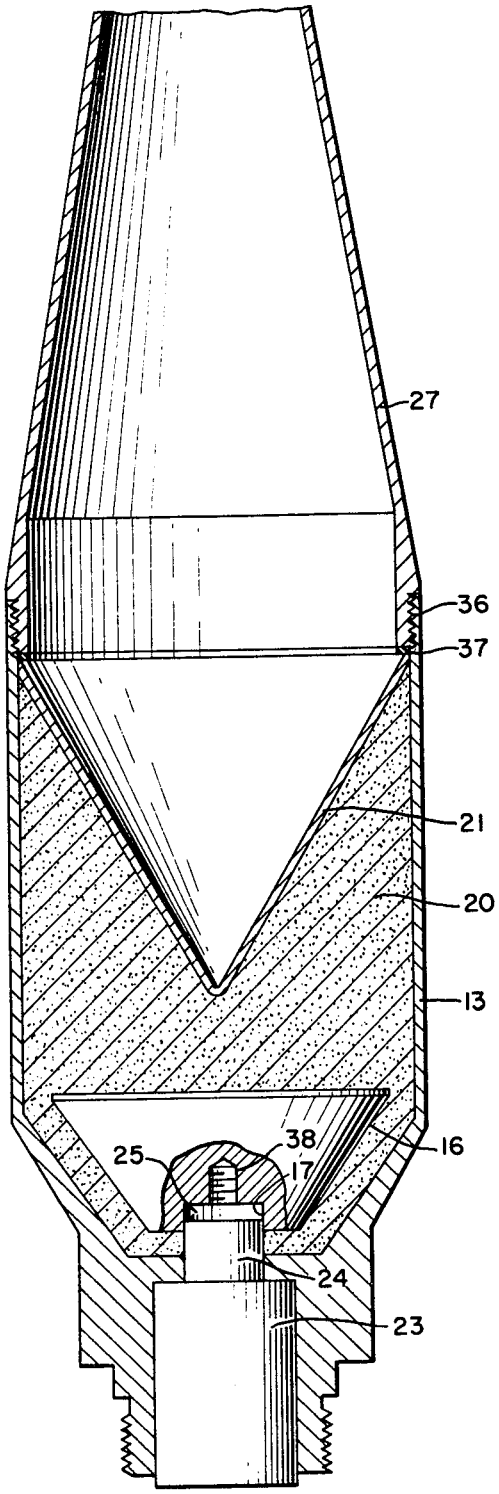
Figure 3A:
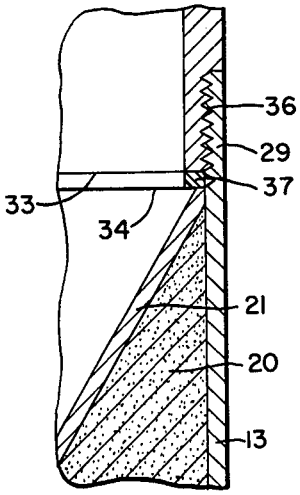

The invention is illustrated in the embodiments shown in the drawings and will be explained in greater detail below with reference thereto. The figures of the drawings show, in each case in a longitudinal sectional view, the following:

FIG. 1 illustrates an explosive charge in pulverulent form prior to the compacting step;

FIG. 1*a* shows the explosive charge after the compacting step;

FIG. 2 shows a compacted explosive charge on an enlarged scale;

FIG. 2*a* shows an enlarged fragmentary view thereof;

FIG. 3 shows a variation of the explosive charge according to FIG. 2; and FIG. 3*a* shows an enlarged fragmentary view of a portion of the variation shown in FIG. 3.

According to FIG. 1, the press tool comprises the die 1, the tubular extension 2 for the guidance of the top ram 3 and for receiving the loose particulate explosive, the bottom ram 4, and the central mandrel 5 displaceable therein in the axial direction. The mandrel 5 rests in the forward direction by way of its shoulder 6, here fashioned as a radial annular surface, on a corresponding counter surface of the bottom ram 4, so that the mandrel is arranged with its front end 7 in a defined position within the compacting chamber 8. In this initial position, the mandrel 5 is held by means of the pretensioned coil spring 9, the latter resting in the downward direction in the abutment 10 of the bottom ram 4. The bottom ram 4 and the mandrel 5 are provided with the longitudinal slots 11 and 12, into which engages a transverse yoke, not shown, to effect the automatic retraction of the mandrel 5 during the ejection of the finished, compacted explosive charge from the press tool.

The compacting chamber 8 is formed by the casing 13 of the explosive charge, this casing being made, for example, of steel. The casing rests toward the outside on the die 1 and on the bottom ram 4. On the bottom of casing 13, the central recess 14 is provided with the perforation 15 in which is inserted the igniter means, especially a detonator with a propagation charge, after the compacting operation. The casing 13 is introduced into the press tool in the empty state so that the mandrel 5 extends through the perforation 15 with its front end 7 into the interior of the casing 13, namely the compacting chamber 8. Thereafter, the inert body 16 is inserted in the casing 13, so that the front end 7 of the mandrel 5 extends into the central, blind-hole-shaped recess 17 of the inert body 16. The recess 17 emanates from the end face 18 of the inert body 16, this end face, according to FIG. 2, faces the igniter means 23, 24, and exhibits a cylindrical wall and a planar bottom 19 extending at right angles to this wall; the mandrel 5 contacts the bottom 19 with its front end 7. Thus, the inert body 16 is arranged centrally in a defined manner within the compacting chamber 8, so that the empty space to be filled with the explosive is determined to be laterally around this body and underneath this body, in reproducible fashion.

After the introduction of the amount of pulverulent explosive 20 required for the respective explosive charge, the inert body 16 is embedded in the explosive 20 except for the zone corresponding to mandrel 5. The conical hollow charge insert 21, made preferably of copper, and the top ram 3 are placed on the poured bulk of explosive, which still fills, in part, the extension 2. Thereafter, the explosive 20 is compacted, for example by means of a hydraulic press. During the pressing step, the inert body 16 with the mandrel 5 is shifted downwardly in the compacting direction, so that a defined compacting of explosive takes place also underneath the inert body 16 and around this body, this compacting corresponding to the compacting executed above the inert body 16. Consequently, the finished, compacted explosive charge exhibits the required uniform density and freedom from gaps.

FIG. 1*a* shows the finished, compacted charge still present within the press tool; at this point, the entire, uniformly compacted explosive 20 is within the casing 13. The mandrel 5 is shifted axially downwardly together with the inert body 16, so that its shoulder 6 is at a spacing from the counter or mating surface 22 of the bottom ram 4. The compacted charge is ejected from the tool in a conventional fashion. During this step, the mandrel 5 is automatically pulled out of the recess 17 of the inert body 16.

FIG. 2 shows the compacted explosive charge as produced by the present invention, after having been discharged from the press tool, this being a hollow charge projectile. The igniter means 23 is inserted in the rear end of the casing 13; this igniter means engages form-fittingly with its central extension 24 into the recess 17 of the inert body 16 in such a way that an empty space 25 remains in the inert body, preventing, in cooperation with its residual wall thickness 26, the transmission of the shock wave from the igniter means 23, 24 through the inert body 16. Therefore, the detonation must perforce pass from the igniter means 23, 24 around the inert body 16, resulting in an annularly configured ignition.

The hollow charge projectile has at its front end the hoodshaped cover or ballistic cap 27 glued with its rear end 28 into the front end 29 of the casing 13. For this purpose—as shown in greater detail in FIG. 2*a*—a predetermined amount of adhesive, for example a bicomponent adhesive on epoxy resin basis, is applied to the inner surface 30 of the front end 29 of casing 13 and to the outer surface 31 of the rear end 28 of cap 27; then, the cap and the casing are pushed together until the cap contacts with its radial shoulder 32 the front rim of the casing 13. During this step, the excess adhesive is pressed by the rearward end face 33 of the cap 27 against the rim 34 of the hollow charge exert 21, so that the insert, after hardening of the seam 35 of adhesive is firmly joined to the casing 13 and to the cap 27, and thus is fixedly in contact, without any gaps, reliably with the explosive body 20 in a very simple fashion. Any adhesive forced toward the outside perhaps from the forward end 29 of the casing during the joining of the cap and the casing is removed prior to hardening.

In the hollow charge projectile shown in FIG. 3, the ballistic hood 27 is conventionally threaded into the front end 29 of the casing 13. Therefore, during the compacting of the loose explosive, the latter must be pressed through the threaded bore 36 of the casing 13 into the latter, whereby it can happen that the explosive is ignited. As is shown in greater detail in FIG. 3*a*, a spacer ring 37, which yields resiliently in the axial direction, is arranged between the rim 34 of the hollow charge insert 21 and the rearward end face 33 of cap 27, in order to compensate for the differences in length due to manufacturing tolerances. As contrasted to FIG. 2, the recess 17 of the inert body 16 is provided, in the projectile of FIG. 3, also with a central threaded bore 38; during the compacting operation, the mandrel 5 of the press tool is threaded into his bore with a corresponding threaded extension at its front end 7. After the compacting step, the mandrel 5 must be unscrewed from the inert body 16 so that the mandrel can then be pulled out of the explosive charge.

We claim:

1. A process for the production of compacted explosive charges, especially hollow charges, wherein a pulverulent explosive is compacted to form a charge within a compacting chamber and an inert body is arranged in the charge, characterized in that the inert body is a shaped member and is arranged within the compacting chamber in a predetermined starting position, to be displaceable in the compacting direction; and the pulverulent explosive for forming the charge including the portion surrounding the inert body is compacted under displacement of the inert body in a single pressure-molding operation, the pulverulent explosive being introduced into the compacting chamber prior to the pressure-molding operation.

2. A process according to claim 1, characterized in that the inert body is guided axially by means of a coaxially arranged mandrel during the displacement of the inert body.

3. A process according to claim 2, characterized in that the mandrel is shifted together with the inert body relatively to the compacting chamber.

4. A process according to one of claims 1, 2 or 3, characterized in that the pulverulent explosive is introduced into the compacting chamber along the run of the chamber, the chamber containing the inert body in a coaxial arrangement before introduction of said explosive.

5. A process, especially according to one of claims 1, 2 or 3, wherein the explosive charge is provided with a casing, a hollow charge insert, and a cover cap, the rear end of the cover cap extending into the front end of the casing being joined to this front end, characterized in that a predetermined amount of adhesive is applied to the inner surface of the front end of the casing and also to the outer surface of the rear end of the cap, and a portion of the adhesive is pressed, during the pushing together of casing and cap, against the front end of the insert in such a way that simultaneously with the gluing together of casing and cap, the insert is likewise fixed in position by the gluing step.

6. The process according to claim 1, characterized in that the inert body is made of a metal or a synthetic resin and the inert body is centrally arranged in the compacting chamber in the predetermined starting position to provide an annular gap between the body and an inner wall of the compacting chamber and thereafter the explosive required for forming the charge is introduced into the compacting chamber, the explosive flowing through the annular gap into an empty space underneath the inert body.

* * * * *